US008157404B2

(12) United States Patent
McDermott

(10) Patent No.: US 8,157,404 B2
(45) Date of Patent: Apr. 17, 2012

(54) VISIBLE LIGHT TRANSPORTER

(76) Inventor: Kevin F McDermott, Rockledge, FL (US)

( * ) Notice: Subject to any disclaimer, the term of this patent is extended or adjusted under 35 U.S.C. 154(b) by 266 days.

(21) Appl. No.: 12/456,750

(22) Filed: Jun. 22, 2009

(65) Prior Publication Data

US 2010/0321934 A1 Dec. 23, 2010

(51) Int. Cl.
*A45C 15/06* (2006.01)
*F21V 33/00* (2006.01)

(52) U.S. Cl. ..... 362/156; 362/154; 362/278; 362/320

(58) Field of Classification Search ..... 313/110, 313/113, 512; 362/311, 339, 800, 255, 327, 362/337, 309, 156, 154, 278, 320, 321, 283
See application file for complete search history.

(56) References Cited

U.S. PATENT DOCUMENTS

| | | | | |
|---|---|---|---|---|
| 5,211,469 | A * | 5/1993 | Matthias et al. | 362/101 |
| 5,438,486 | A * | 8/1995 | McNair | 362/512 |
| 5,452,190 | A * | 9/1995 | Priesemuth | 362/255 |
| 5,803,579 | A * | 9/1998 | Turnbull et al. | 362/516 |
| 5,899,557 | A * | 5/1999 | McDermott | 362/244 |
| 6,227,685 | B1 * | 5/2001 | McDermott | 362/318 |

OTHER PUBLICATIONS www.galls.com → click on FireAuthority.com Tab (at top) → click on Traffic Safety (on left hand side) → click on Traffic Control Equipment, 1998.
www.nationalsafetyinc.com, 2000.
www.emergencyroadflares.com, 2007.
www.turboflare360.com, 2002.
www.pflare911.com, 2009.

* cited by examiner

*Primary Examiner* — Joseph L Williams
(74) *Attorney, Agent, or Firm* — Kevin T. Price

(57) ABSTRACT

A visible light transporter (1) having a carrier (25) for holding a plurality of lighting devices (L1 through L4). The lighting devices frequently employed as road flares emit a light usually concentrated into a horizontal light beam (HB) and pulsing. Carrier (25) has body 9 constructed of a light transmitting resin which permits light from the held lighting devices to be transmitted with attenuation through body 9 of the carrier. Carrier (25) also includes openings (01 through 04) which permit lighting devices (L1 through L4) to be removeably installed in pockets (S1 through S4) provided for holding the lighting devices. Openings also permit some light to pass unattenuated exterior to carrier (25). The unattenuated light (HBU) and the transmitted light (HBT) each combine exterior to carrier 25 to make it appear as a large pulsing light source and to illuminate the first responder holding the visible light transporter (1) making him visible and thereby protecting him from being injured by approaching vehicles as he deploys the lights.

39 Claims, 5 Drawing Sheets

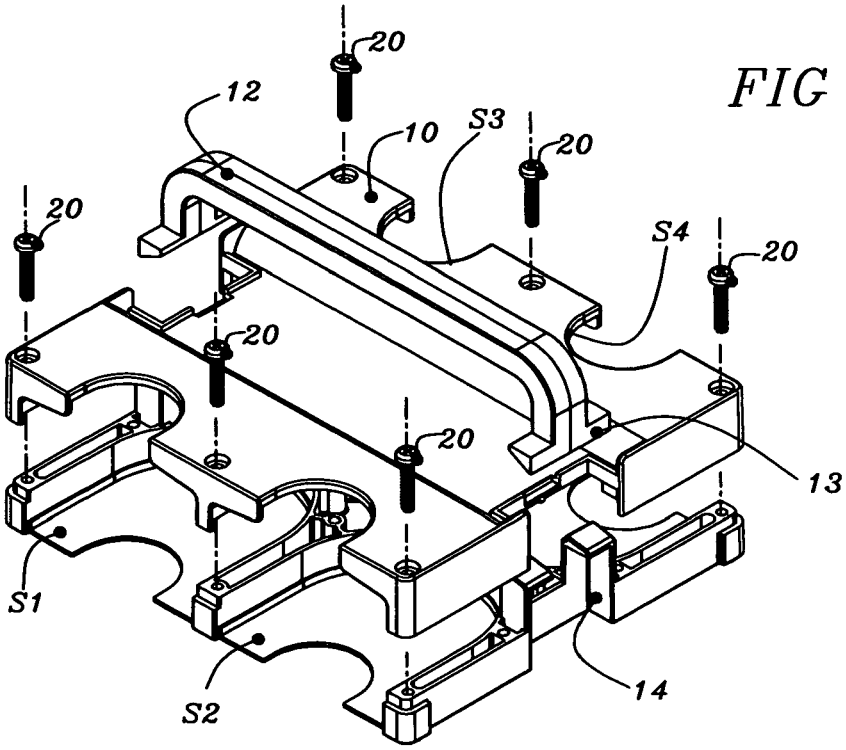
FIG 10
FIG 11
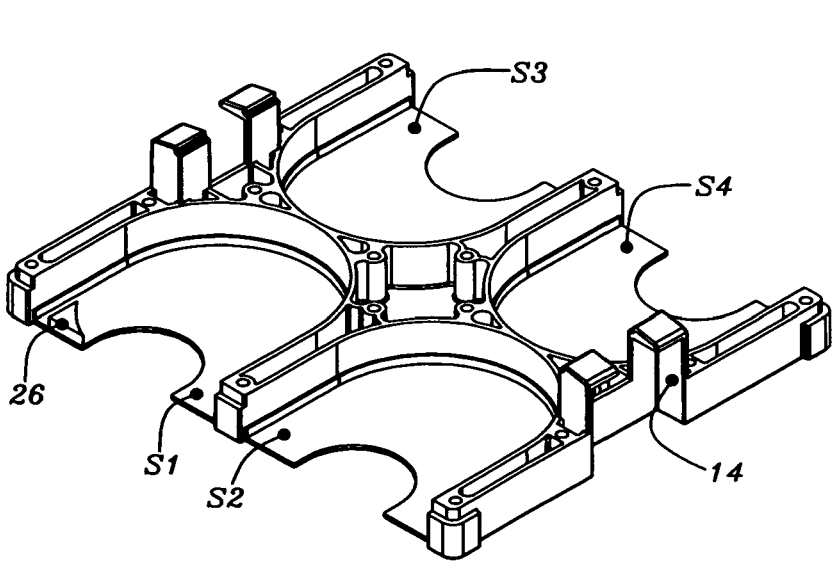

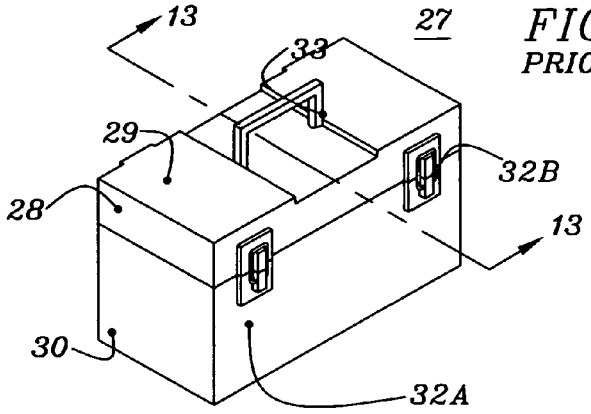
FIG 12
PRIOR ART
FIG 13
PRIOR ART
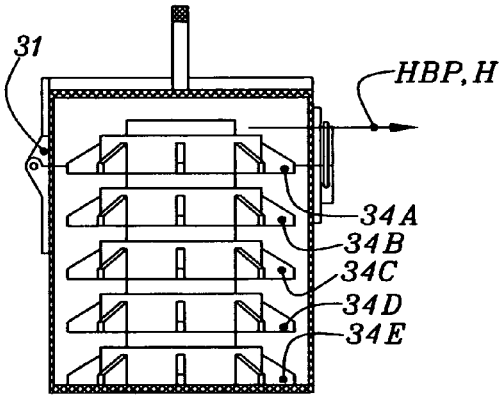
FIG 14
PRIOR ART
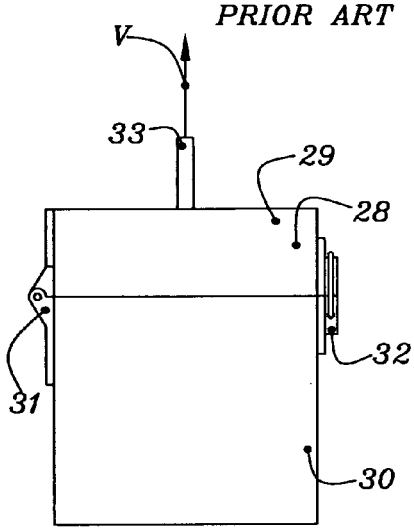
FIG 15
PRIOR ART
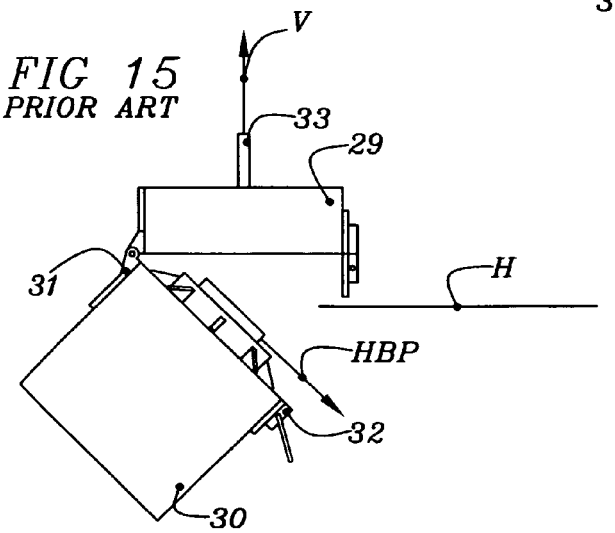

VISIBLE LIGHT TRANSPORTER

BACKGROUND OF THE INVENTION

1. Field of Invention

First responders often are confronted with the task of alerting the driving public to hazardous zones such as accident scenes. In nighttime situations incendiary road flares have traditionally been deployed around the hazard to guide advancing traffic safely past the danger. Incendiary road flares are very bright but they are also hazardous. Therefore they are being replaced by electric lights also known as flares, electric flares, lighting devices or lights. The electric lights usually emit a pulsing light as pulsing lights attract more attention. The lights are placed on the road to signal to approaching vehicles the fact that a hazard exists. It is common practice for several of the lights to be placed in the roadway forming a wedge to guide approaching vehicles around the hazard. The lights are usually designed to concentrate their emitted light into a powerful horizontal light beam in order that they provide the high intensity signal expected of incendiary road flares. These horizontal light beams are often directed throughout the azimuth but they can also be aimed in a single direction. Once lighted and in place the lights emit their powerful horizontal light beams to alert drivers to the hazard. However, regardless of whether the responder uses an incendiary flare or electric light a problem exists during deployment and retrieval as the first responder is unlighted and on a dark roadway. Oncoming drivers can easily fail to see the first responder resulting in a catastrophic accident.

2. Prior Art

Prior art includes electric lights or flares that are placed on the road. Small electric lights often replace incendiary road flares because they avoid the hazards created by pyrotechnic systems. The individual lights commonly available include a light concentrating optic to form an intense light beam directed along the horizontal when the light is in its deployed position. The lights are commonly stored within a hard opaque plastic case having a handle similar to a tool box or stored in a fabric pouch in groups of four to eight. When needed they are removed from the case, switched on and placed on the roadway. The fabric pouches usually include a shoulder strap permitting the first responder to sling it over his shoulder and carry the group of lights while placing them in a wedge formation at a substantial distance before the obstruction.

The process of dispensing and retrieving these lights is dangerous. The prior art procedure for lights held in a pouch includes locating the lights within the vehicle, opening the fabric pouch and slinging it over the responders shoulder. Next while walking towards traffic the first responder must turn on and deploy the first light. This is repeated for each of the lights in the pouch. This procedure is reversed when retrieving the lights. Therefore during the deployment procedure of the prior art lights the responder is unlighted and at risk.

The prior art procedure for transporting and dispensing lights held in a plastic case is more difficult. These tool box type cases have a hinged cover which is latched to the bottom of the case so that the flare kit can be transported and stored without loosing the held lights. The lights during the transporting orientation are completely enclosed within the opaque case. If the lights are illuminated their light beams could in some prior art designs be directed along a horizontal. However since the tool box is completely closed and substantially opaque only a small amount of light emerges. Some light can emerge due to cracks or seams in the tool box. Also if the held lights are powerful enough a small amount of light can pass through the opaque plastic case. This occurs because although plastic resins are identified as opaque, translucent or transparent in practice they rarely function exactly as any of the identifiers indicate. For example a transparent case is rarely totally transparent. It will normally exhibit some of the light scattering and diffusion expected of a translucent case. Similarly an opaque case will permit a small amount of a powerful light beam to pass through and emerge diffused.

FIGS. 12 through 15 to be later described describe a prior art road flare lighting kit.

Although not offered as a method by any manufacturer the responder using prior art designs can energize the lights prior to entering the roadway. However the prior art case does not secure the individual lights such that their light beams remain horizontal during their removal from the case nor does it permit the light to emerge from the case along a horizontal direction having an intensity sufficient for it to be seen by an oncoming driver. Therefore although a responder can energize his prior art lights and replace them in their case before entering the roadway there is no prior art reason to make that effort. The possible advantages of placing energized lights in the case are not realized due to the low transmissivity of the cases offered by the manufacturer. In addition there are problems related to a responder energizing lights and placing them in the prior art case. Specifically the individual lights are very intense within their light beam. Prior art is not securing the lights such that the emitted light beam remains horizontal during transporting and deployment can—if the lights are illuminating—temporarily blind the responder creating a new hazard.

Prior art does not include the following features:

- Prior art lights are not visible through a translucent or transparent carrier as they are being transported to a deployment location.
- Prior art does not provide pockets with activation openings to easily activate a switch to energize the lights while still in the carrier.
- Prior art does not provide pockets with openings to install the lights into the carrier without opening a cover or door.
- Prior art in not holding the lights with their light beam in a horizontal orientation during deployment and transportation risks exposing the first responder to bright flashes of light causing temporary blindness.
- Prior art does not provide an opening in each pocket of the carrier for some of the emitted light from each held lighting device to pass unobstructed and unattenuated to the exterior of the carrier along the horizontal to sum or combine to make the carrier a highly visible object protecting the responder
- Prior art does not use light emerging from the carrier to illuminate the responder during deployment or retrieval of the lights.
- Prior art does not secure the lights within a light transmitting carrier oriented such that the concentrated horizontal light beams emitted from the lights emerge from the carrier along a horizontal to combine to make the carrier a highly visible object protecting the first responder.
- Prior art does not provide a light transmitting carrier combining the emerging light from a plurality of held lighting devices to effect a powerful horizontal light beam emerging from the carrier making it a personal warning light protecting the first responder.
- Prior art does not offer a method or reason for activating the lights within the carrier prior to deploying the lights.

Prior art does not provide an opening in the carrier permitting the lights to be removed while the carrier remains in a transporting orientation.

3. Objects and Advantages

The objects and advantages of the present invention are to improve upon the safety of responders as they deploy lighting devices including electric lights used as road flares. During the deployment procedure the first responder is vulnerable as he is on foot and he is unlighted. Often emergency vehicles which have lights are on the scene. However, the powerful emergency vehicle lights frequently exacerbate the safety problem for the responder as those lights blind advancing drivers making it difficult for them to see the responder in the roadway as he is deploying flares.

The present invention provides a carrier for holding a plurality of energized lighting devices. The carrier is designed to permit light emitted from each of the held lighting devices to emerge from the carrier making the carrier and the responder holding it highly visible objects. The light emerges from the carrier either by passing through the light transmitting resin used to construct the carrier or unattenuated through openings in the carrier. Light which passes through the carrier will be attenuated to some degree depending upon the resin. In order for light to pass exterior to the carrier unattenuated it must pass through an opening in the carrier. The emerging light from the plurality of held lights combines to make the carrier a highly visible object. A portion of the emerging light illuminates the responder holding the carrier making him visible to oncoming drivers.

The held lights when in their standing or deployed orientation usually provide concentrated light beams directed along the horizontal in order to maximize the intensity of the light viewed by oncoming drivers also along the horizontal. The carrier is designed to hold the lights such that their emitted light beams remain directed along the horizontal to maximize their visibility during transportation and while standing. Also, in holding the lights within the carrier such that during transportation their emerging light beams emerge horizontally avoids directing very powerful light beams into the eyes of the responder and therefore avoids temporarily blinding him. The carrier also will usually transmit and diffuse some of the light. This makes the carrier appear large and visible from all angles of viewing thereby assuring its visibility from all angles of approach.

The referenced prior art does not teach or address the following concepts which are employed in the current invention.

The present invention includes a light transmitting carrier which transmits some (a far from negligible) portion of the light emitted by a plurality of held lights through the walls of the carrier towards advancing vehicles such that the transmitted light has an intensity sufficient to alert drivers of a first responder's presence thereby making the carrier a highly visible safety warning device.

The present invention includes a carrier for holding a plurality of lights such that some (a far from negligible) portion of the light emitted by the held lights passes unattenuated through openings in said carrier such that the transmitted light has an intensity sufficient about a horizontal to warn approaching drivers of the presence of a first responder thereby making the carrier a highly visible safety warning device.

The present invention includes a carrier for holding a plurality of lights in such a way that the first responder can activate the lights without removing them from the carrier thereby reducing the time required to deploy the lights.

The present invention includes a carrier holding a plurality of lighting devices for either temporary or permanent attachment to a surface such that light emitted from the lighting devices emerges from the carrier along a horizontal to serve as a safety beacon.

The present invention minimizes the time spent by first responders in the roadway setting up and retrieving lights thereby reducing accidents.

The present invention holds the lighting devices in a standing orientation directing their light beams to emerge along a horizontal to provide supplementary illumination when left standing or when disposed on a vehicle to increase the visibility of the vehicle and reduce accidents.

The present invention holds lights having concentrated light beams within a carrier with the lights positioned such that the concentrated light beams emerge from the carrier to overlap and sum so that the emerging light is a powerful horizontal beam.

The present invention permits at least a portion of the light emitted from each held light to pass horizontally unattenuated to oncoming vehicles providing an intense warning beacon. Another portion of the emitted light passes through the translucent plastic carrier. The diffusing feature of the translucent plastic sums light from a plurality of held lighting devices to turn the carrier into a large glowing highly visible object providing a second type of safety beacon.

The present invention illuminates the first responder as he transports, deploys and retrieves the road flares making him more visible and therefore safer.

The present invention uses the variations amongst the pulse rates of the plurality of held lights to create a highly visible carrier that pulses randomly and at a higher frequency than the held lights.

The present invention employs a carrier with a nonrotatable or fixed handle to facilitate the installation and removal of held lighting devices and to prevent inadvertent misdirection of their powerful light beams.

The present invention provides pockets with restrictions to facilitate rapid installation and removal of held lighting devices while still securely holding them.

The present invention holds a plurality of pulsing lighting devices and permits their light to emerge at different locations on a carrier to provide a pulsing signal that jumps to different locations thereby creating a highly visible object.

Further objects and advantages are realized through combinations of the above distinct advantages.

SUMMARY

A visible light transporter includes a light transmitting carrier or case which holds a plurality of portable energized lighting devices such that light emitted from the lights held by the carrier emerges from the carrier transporting them forming a powerful safety beacon to alert all persons in the area that a first responder is present thereby avoiding accidents. First responders using the visible light transporter of the present invention are visible as they deploy and retrieve the lights. This enhanced visibility reduces accidents. In addition the ability to install, retrieve or activate the lights without opening the case or carrier reduces the time required to deploy the lights thereby further reducing accidents. The carrier includes a pocket for each of the lights to be held. It also includes an opening on one of its sides for each of the pockets permitting quick installation and removal of each light from its pocket. The carrier is constructed of a nonopaque light transmitting resin to form a first means for the light emitted by the held lights to emerge. The resin, which is usually partially translucent, diffuses the light making the entire carrier glow appearing as a large highly visible defined object. In addition the carrier permits additional light from the held lights to emerge through openings in the carrier unattenuated. The held lights each usually have a concentrated horizontal light beam which emerges horizontally because the carrier in both a standing and a transporting orientation holds the lights horizontally permitting the light to pass through strategically placed openings to emerge along a horizontal direction. This emerging light from each of the held lights combines exterior to the carrier to form a powerful horizontal beam exterior to the carrier making the carrier appear as a large and visible safety device even when viewed from large distances. One or more openings in the carrier permit installation and removal of the lights without opening a cover, access to activate the lights, access to grip the lights for removal from the carrier and pathways for light from the held lights to escape unattenuated from the carrier. Some of the openings provide several of the aforementioned functions.

Finally the held lighting devices are usually emitting a pulsing light. The plurality of unsynchronized pulses from the held lights combine to create a spectacular and highly visible light transporter which appears to be pulsing at a frequency higher than the frequency of any of the held lighting devices.

DRAWINGS

Figures

FIG. 10 is an assembly view of carrier 25 of FIG. 1

FIG. 11 is a perspective view of carrier bottom 11 removed from FIG. 9

FIG. 12 shows a perspective view of a prior art road flare kit

FIG. 13 shows a partial cross section across line 13-13' of FIG. 12

FIG. 14 shows an end view of the road flare kit of FIG. 12 in transporting orientation FIG. 15 shows an end view of the road flare kit of FIG. 12 except that latches 32A and 32B are open

Figure 1:
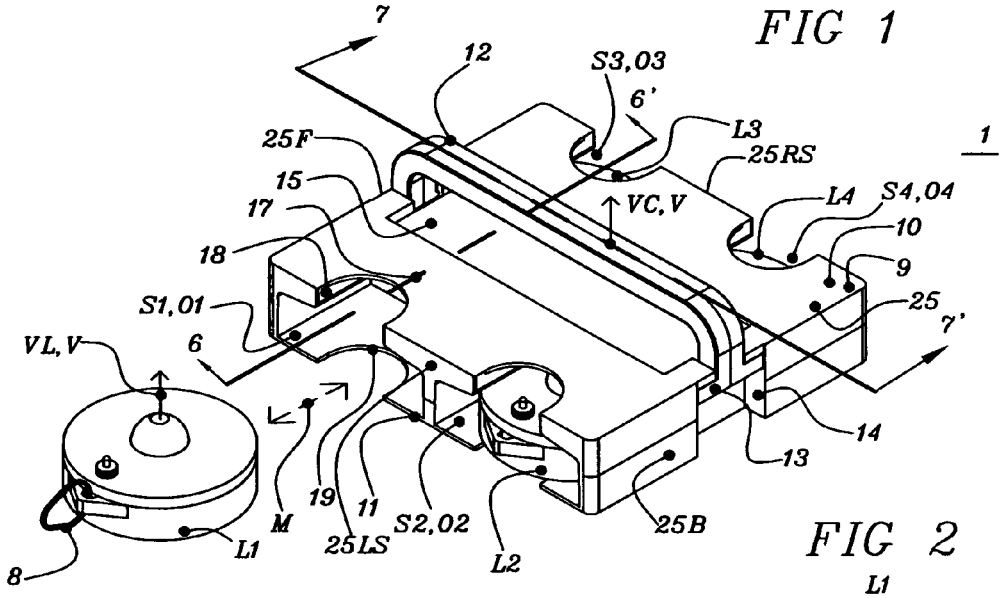
FIG. 1 is a perspective view of visible light transporter 1 having carrier 25 transporting four lighting devices

| DRAWINGS - Reference Letters | | DRAWINGS - Reference Numerals | | | |
|---|---|---|---|---|---|
| C1 | Approaching Car | 1 | visible light transporter | 2 | housing |
| C2 | Obstructing Car | 3 | cover | 4 | base |
| DE | Extended Distance | 5 | window | 6 | main switch |
| DS | Separation Distance | 7 | adapter | 8 | lanyard |
| H | Horizontal Plane | 9 | body | 10 | carrier top |
| H1 | Horizontal Plane One | 11 | carrier bottom | 12 | handle |
| HB | Horizontal Light Beam | 13 | wings | 14 | tracks |
| HBP | Horizontal Light Beam Prior Art | 15 | recess | 16 | restriction |
| | | 17 | flex location | 18 | top access opening |
| HBT | Transmitted Portion of Horizontal Light Beam HB | 19 | bottom access opening | 20 | screw |
| | | 21 | velcro strip set | 22 | magnet strip |
| HBU | Unattenuated Portion of Horizontal Light Beam HB | 25 | carrier | 25B | back side |
| | | 25F | front side | 25L | left side |
| HR | Horizontal Road | 25R | right side | 26 | projection |
| HS | Horizontal Shelf | 27 | prior art road flare kit | 28 | case |
| L1 | Lighting Device 1 | 29 | case cover | 30 | case bottom |
| L2 | Lighting Device 2 | 31 | hinge | 32A | latch |
| L3 | Lighting Device 3 | 32B | latch | 33 | handle |
| L4 | Lighting Device 4 | 34A | light | 34B | light |
| M | Horizontal Direction | 34C | light | 34D | light |
| O1 | Opening One | 34E | light | | |
| O2 | Opening Two | | | | |
| O3 | Opening Three | | | | |
| O4 | Opening Four | | | | |
| P1 | Light Emission Point for Lighting Device L1 | | | | |
| P3 | Light Emission Point for Lighting Device L3 | | | | |
| S1 | Pocket One | | | | |
| S2 | Pocket Two | | | | |
| S3 | Pocket Three | | | | |
| S4 | Pocket Four | | | | |
| V | Earth Reference Vertical | | | | |
| VC | Carrier Reference Vertical | | | | |
| VL | Light Reference Vertical | | | | |

-continued

| DRAWINGS - Reference Letters | DRAWINGS - Reference Numerals |
|---|---|
| VL3 Light Reference Vertical for Lighting Device L3 | |
| Z Intersection Zone | |

OPERATIONAL DESCRIPTION OF THE PREFERRED EMBODIMENT FIGS. 1-11

Figure 2:
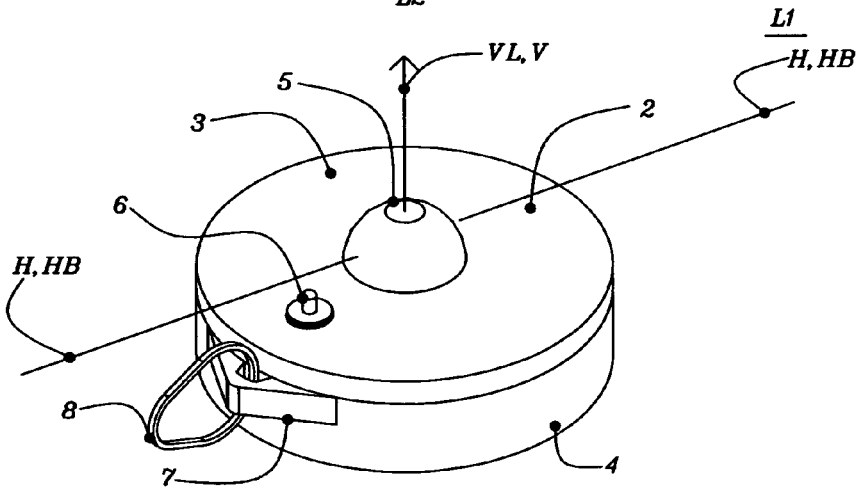
FIG. 2 is a perspective view of one lighting device L1 removed from FIG. 1
Figure 3:
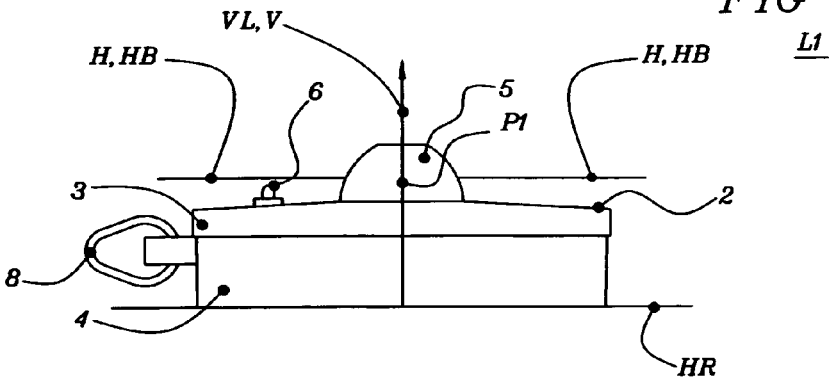
FIG. 3 is a front view of lighting device L1 from FIG. 2 on horizontal road HR

FIGS. 1 through 11 are the preferred embodiments of the visible light transporter 1 of the present invention. FIG. 1 is a perspective view of visible light transporter 1 including carrier 25 for removeably holding four portable lighting devices L1, L2, L3 and L4 normally of identical design. Lighting devices L2, L3 and L4 are shown held by carrier 25. Lighting device L1 is shown exterior to carrier 25, however it can easily be installed in carrier 25 by moving it in horizontal direction M. FIGS. 2 and 3 show perspective and front views respectively of lighting device L1 removed from FIG. 1. Lighting device L1 comprises housing 2 which includes cover 3 and base 4. Base 4 permits lighting device L1 to remain stable and upright when placed on a flat surface such as horizontal road HR. Housing 2 is usually constructed of a tough plastic. Cover 3 usually constructed of a transparent plastic includes window 5 to facilitate light emerging from lighting device L1. Cover 3 supports main switch 6. Housing 2 further includes adapter 7 molded as part of base 4 which serves to secure lanyard 8 to housing 2 for holding and transporting lighting device L1 when it is to be carried individually. Lanyard 8 is also helpful in pulling lighting device L1 from carrier 25. Lighting device L1 comprises a single high intensity led emitting either a steady or a pulsing light selected by a switch. The emitted light is usually concentrated by an internal optic into an intense horizontal light beam HB substantially equally visible throughout the azimuth. A light beam commonly includes the light emerging from a lighting device projected within an angular beam spread having an intensity of at least ten percent of the peak intensity. Alternative optional designs can concentrate the emitted light into horizontal light beams having one or more azimuthal directions. Horizontal light beam HB usually comprises a beam spread of approximately six degrees about horizontal plane H and throughout the azimuth. The beam spread permits some beam configurations to be angled slightly upward while still having concentrated light directed along horizontal plane H. Although in these embodiments horizontal beam HB emerging from carrier 25 is not centered about horizontal plane H it is still to be considered as emerging along horizontal plane H since horizontal plane H is within the beam spread of horizontal beam HB. Main switch 6 is used to activate lighting device L1, however using conventional design procedures and microcontrollers main switch 6 can also be used to change the pulse parameters of lighting device L1 or to place lighting device L1 in a steady on mode. Lighting device L1 is designed so that when disposed on base 4 in a standing or deployed position its light reference vertical VL is substantially parallel to earth reference vertical V and its emitted light beam is directed along horizontal plane H. Lighting device L1 employs a single led emitter positioned at the center of window 5 and positioned along light reference vertical VL. Therefore the single light emission point for lighting device L1 is P1 located along light reference vertical VL.

FIG. 3 shows lighting device L1 in its deployed orientation with base 4 on horizontal road HR. When disposed in its deployed or standing orientation light reference vertical VL is parallel to earth reference vertical V and horizontal light beam HB emitted from window 5 is along horizontal plane one H1. Lighting device L1 is constructed with base 4 being wide, having a low profile and low center of gravity so that it can withstand accidental run over by approaching vehicles without damage and without being knocked down or rotated from its standing position.

Figure 4:
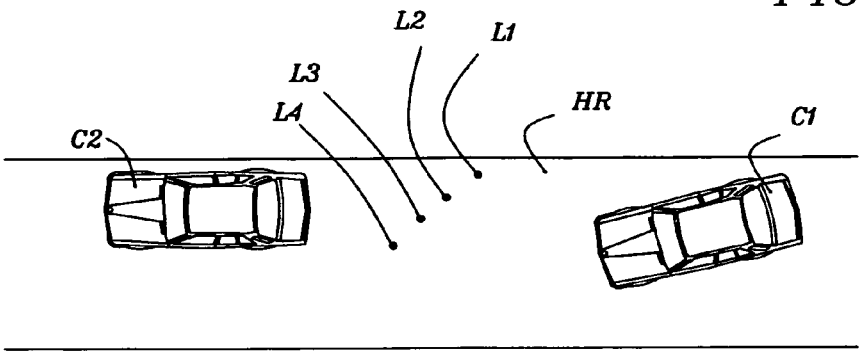
FIG. 4 is a top view of a typical road hazard scene

FIG. 4 is a top view of a typical road hazard scene employing lighting devices L1 through L4 on horizontal road HR where lighting devices L1, L2, L3 and L4 after being removed from carrier 25 are placed in a wedge formation to direct approaching car C1 safely around inoperable obstructing car C2.

Figure 5:
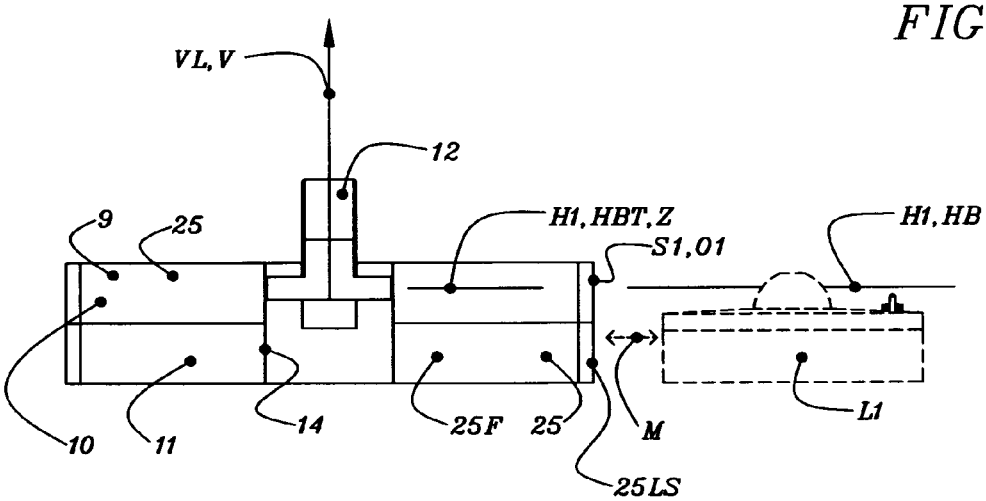
FIG. 5 is a front view of visible light transporter 1 in a transporting orientation

FIG. 5 is a front view of visible light transporter 1 including carrier 25 in a transporting orientation. In FIG. 5 lighting devices L1 through L4 are held by carrier 25 even though they are not visible. Lighting device L1 is shown as a dashed image exterior to carrier 25 to indicate its position after being pulled from carrier 25 along horizontal direction M. The transporting orientation is—like the standing orientation—the orientation at which light reference vertical VL is parallel to earth reference vertical V. It is substantially the orientation visible light transporter 1 including carrier 25 assumes when being held by handle 12. In the transporting orientation horizontal light beam HB of lighting device L1 is parallel to horizontal plane one H1. In both the standing orientation and transporting orientation lighting device L1 held in carrier 25 emits its horizontal light beam HB parallel to horizontal plane one H1. Openings in carrier 25 which exist in both the transporting and standing orientations permit easy installation and removal of the lighting devices from carrier 25 thereby avoiding delays or fumbling during the deployment of the lighting devices.

Figure 6:
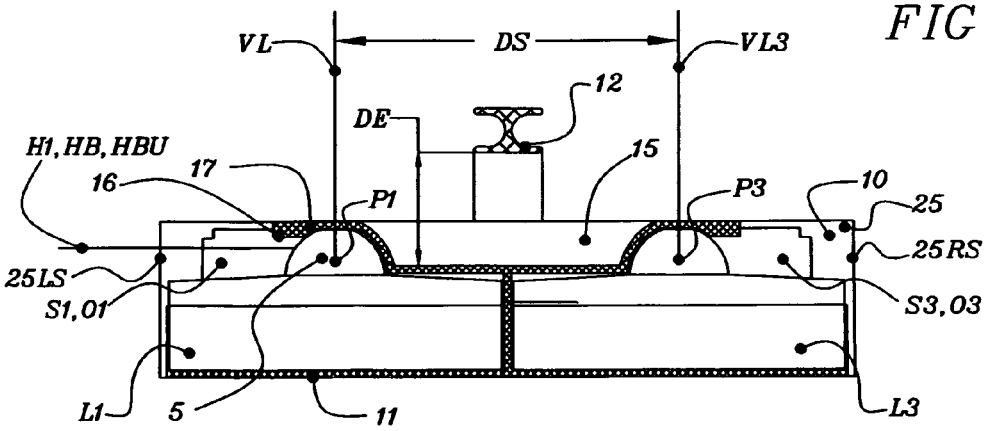
FIG. 6 is a partial cross-sectional view taken across 6-6' of FIG. 1
Figure 7:
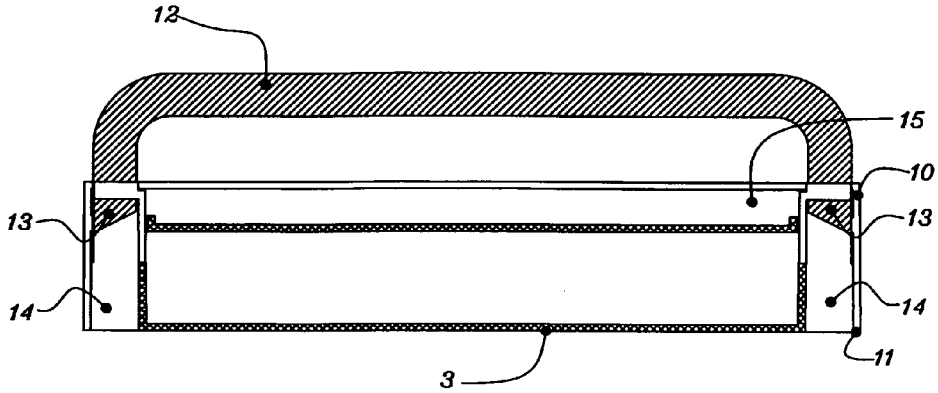
FIG. 7 is a partial cross-sectional view taken across line 7-7' of FIG. 1

FIG. 6 is a partial cross-section of FIG. 1 across line 6-6' except lighting devices L1 through L4 are all installed in their respective pockets S1 through S4. FIG. 7 is a partial cross-section of FIG. 1 across line 7-7'.

Figure 8:
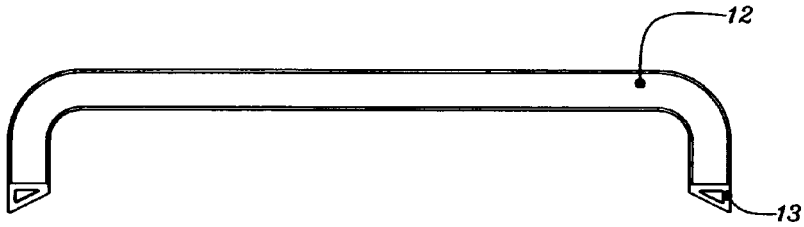
FIG. 8 is a front view of the handle removed from FIG. 1

In FIGS. 1, 5 and 6 visible light transporter 1 is for transporting four portable lighting devices L1, L2, L3 and L4. Carrier 25 can be designed to hold a quantity of lighting devices different than the four lighting devices shown. In FIG. 1 lighting device L1 is removed from carrier 25 but can be quickly installed by pushing it in horizontal direction M into pocket one S1 on the left side 25L of carrier 25. Lighting devices L2, L3 and L4 have pocket two S2, pocket three S3 and pocket four S4 respectively for holding them in carrier 25. In the present embodiment pockets S1 through S4 are contoured to hold lighting devices L1 through L4. There are numerous alternate contours for pockets S1 through S4 which will acceptably hold lighting devices L1 through L4. In addition each alternate shape of lighting device L1 will also have a variety of acceptable pocket contours. In the present invention any contour of carrier 25 which holds a lighting device at a substantially fixed position within carrier 25 is to be considered a pocket. It is noteworthy to realize that carrier 25 could be constructed to hold a plurality of lighting devices without individual pockets and still employ some concepts of the present invention. FIG. 8 is a side view of handle 12 removed from FIG. 1. Looking back at FIG. 1 carrier 25 includes body 9 which comprises carrier top 10 and carrier bottom 11 which are fastened or glued together by conventional means. Carrier 25 comprises front side 25F, back side 25B, left side 25L and right side 25R. Carrier 25 can be cast from a variety of light transmitting resins extending from a clear transparent resin which permits a large percentage of the light from each held lighting device to pass with minimal attenuation or diffusion to a translucent resin which diffuses the light and increases attenuation. Transparent resins can be expected to have a transmissivity exceeding seventy five percent when tested with a light of the color expected to be transmitted. Translucent resins can be expected to have a diffuse transmissivity exceeding twenty five percent when tested with a light of the color expected to be transmitted. If carrier 25 is cast of a highly or even partially translucent resin a large portion of it will glow due to the diffusing effect of the resin whenever lighting devices L1 through L4 are emitting light. If it is cast of a highly transparent resin the powerful horizontal light emitted from lighting devices L1 through L4 will pass through carrier 25 with minimal attenuation and minimal diffusion to create a high intensity beacon. Each type of light transmitting resin beneficially affects the visibility of carrier 25 in its own way. If carrier 25 is cast of a water clear resin such that it has a rough or etched surface it will result in a carrier that diffuses the light it transports similar to a carrier molded or cast of a translucent resin. Therefore in the present application an etched carrier design is considered as cast of a translucent resin since the surface finish makes the molded resin translucent.

Looking at FIGS. 1, 5 and 6 carrier 25 transports lighting devices L1 through L4 all in a transporting orientation. In FIG. 6 the light emission point for lighting device L1 is P2 along light reference vertical VL. Similarly the light emission point for lighting device L3 is P3 along light reference vertical VL3. Therefore the distance between the light emission points of lighting devices L1 and L3 is separation distance DS which should be at least two inches to create an acceptable light jumping effect. It subsequently emerges from carrier 25 at separate locations about horizontal plane one H1 making carrier 25 appear as a large visible light source emitting more light than the individual lighting devices held within. This emitted light makes carrier 25 highly visible to oncoming drivers. It also illuminates the responder holding the carrier and identifies the location of the responder thereby protecting him from being hit by an advancing vehicle. Carrier 25 employs either one or both of two optical light passing features in full or in part to increase its visibility. In this regard the first or transmitting feature is employed when some of the light, irrespective of whether it is in the form of horizontal light beam HB or an alternate pattern of light, emitted from lighting device L1 intersects carrier 25 and is transmitted through light transmitting body 9. The second or unattenuating feature is employed when some of the light, irrespective of whether it is in the form of horizontal light beam HB or an alternate pattern of light, emitted from lighting device L1 passes unattenuated through an opening in body 9 of carrier 25. Carrier 25 is designed to employ a similar light passing design for each of the held lighting devices including lighting devices L2, L3 and L4.

Light emerging from carrier 25 comprises a transmitted portion HBT of horizontal light beam HB which passes—as previously described—from held lighting device L1 through the light transmitting material used to construct carrier 25 and an unattenuated portion HBU of horizontal light beam HB which emerges from carrier 25 by passing unattenuated through an opening in carrier 25. The transmitted portion HBT of horizontal light beam HB creates a large visible lighted carrier excellent for clear identification and the unattenuated portion HBU of horizontal light beam HB creates a large visible carrier having a powerful light beam visible from a long distance. Looking at FIGS. 5 and 6 but especially at FIG. 5 with lighting device L1 in pocket S1 a portion of horizontal light beam HB identified as transmitted portion HBT of horizontal light beam HB intersects body 9 at carrier top 10 at intersection zone Z along horizontal plane one H1. This light is transmitted through carrier top 10 both diffused and attenuated to emerge about horizontal plane one H1. This transmitted portion HBT of horizontal light beam HB would be diffused to some degree depending upon the resin chosen to mold carrier 25. This transmitted light emerging about a horizontal combines with transmitted light emerging from the other held lighting devices at other similar zones separated by a predetermined distance usually at least two inches on carrier 25 to make carrier 25 appear as a large visible light source.

The unattenuated portion of the light emitted by each of the held lighting devices passes unattenuated through openings in carrier 25. Looking back at FIG. 3 lighting device L1 emits concentrated horizontal light beam HB along horizontal plane H and throughout the azimuth. Now looking at FIG. 6 horizontal light beam HB leaves window 5 of lighting device L1. A portion of horizontal light beam HB is directed along horizontal plane one H1 such that it passes through opening one 01 in pocket one S1 of carrier 25. This light is the unattenuated portion HBU of horizontal light beam HB and it emerges about horizontal plane one H1 unattenuated to combine with some unattenuated light from the other held lighting devices emerging from separate locations on carrier 25 to make carrier 25 appear as a large visible light source with a powerful light beam.

Lighting devices L1 through L4 often emit a pulsing light. In this instance, since the held lighting devices are not synchronized, carrier 25 will appear to be pulsing at a random and changing frequency thereby further increasing the effectiveness of visible light transporter 1 as a warning device. In addition since the pulses per minute of carrier 25 will approximate the sum of the pulses per minute of each held lighting device carrier 25 will pulse at a frequency higher than the frequency of any of the held lighting devices further increasing its visibility. Finally the pulses will emerge from a plurality of locations on carrier 25 creating a light jumping effect making visible light transporter 1 an excellent highly visible warning device. Thus lighting devices L1 through L4 not only serve to indicate a hazard when deployed on a roadway but also serve to protect the responder during deployment and retrieval. It is noteworthy to realize that although in the present embodiment a higher frequency pulse increases the visibility of carrier 25 there is a situation wherein the frequency of the individual lights can increase to the point that the sum as seen exterior to the carrier can approximate a steady light thereby causing carrier 25 to loose some of its effectiveness as a safety device. This problem is seen in carriers where the individual held lights each have a quantity (for example 20) of led lamps positioned in a circle and sequentially lit to create a rotating effect. These designs increase the pulse frequency of the carrier by about twenty times the frequency of the single led lamp designs making the carrier appear less like a powerful pulsing object and more like a steady light therefore less effective as a high intensity pulsing safety device.

Looking at FIGS. 1, 5, 7 and 8 carrier 25 includes handle 12 having wings 13 which slide in tracks 14. Handle 12 therefore can move up and down with wings 13 in tracks 14 parallel to carrier 25 reference vertical VC. In FIG. 5 carrier 25 is disposed in a transporting configuration. This is the configuration of carrier 25 permitting it to be carried by handle 12 to establish a transporting orientation in which some of the light emerging from carrier 25 will emerge about a horizontal. Carrier 25 when disposed in a transporting configuration comprises handle 12 having at that configuration a nonrotatable attachment to body 9. Handle 12 has a linear or nonrotatable movement relative to body 9 thereby deterring body 9 from swiveling during transporting and thereby avoiding accidentally directing light into the responder's eyes. In addition a handle having only linear movement or a fixed handle without any movement relative to carrier 25 prevent body 9 from rotating as lights are removed causing carrier 25 to become unbalanced. An unbalanced carrier causing body 9 to be tilted as a result of a rotating handle is difficult to carry and misdirects the light beams from the held lights. Handle 12 moves from extended distance DE—usually exceeding one inch to provide adequate space for a hand—when carrier 25 is transporting lighting devices L1, L2, L3 and L4 to a storage position with extend distance DE reduced to zero and handle 12 in recess 15 permitting carrier 25 to be flat when stored or positioned upside down on a horizontal surface.

FIG. 6 shows lighting device L1 in pocket one S1 located on a left side 25L of carrier 25. Looking at FIG. 1 lighting device L1 is installed in pocket one S1 by pushing it into the left side 25L of carrier 25 in horizontal direction M. Restriction 16 as shown in FIG. 6 is a small mass of plastic molded in opening one 01 as an integral part of carrier top 10 for restricting both the installation and the removal of lighting device L1 from pocket one S1. As lighting device L1 is pushed into pocket one S1 window 5 of housing 2 bumps into carrier 25 at restriction 16 at its natural location. As lighting device L1 continues to be pushed into pocket one S1 window 5 due to its curvature lifts restriction 16 so that lighting device L1 can move further into pocket one S1. Carrier 25 is designed to permit restriction 16 to move upward by having flex location 17 which moves upward as restriction 16 is lifted to a distorted location by window 5 of housing 2. As window 5 moves past restriction 16 restriction 16 snaps back to its natural location and secures lighting device L1 within pocket one S1 of carrier 25. Lighting device L1 can easily be removed from carrier 25 as shown in FIG. 5 by pulling it in horizontal direction M from the side of carrier 25 thereby once again lifting and passing restriction 16 but this time exiting pocket one S1. Carrier 25 therefore has a design which is flexible and which permits installation of lighting device L1 into pocket one S1 to be held securely until it is pulled from pocket one S1. Lighting device L1 can be removeably installed or removed from pocket one S1 through opening one 01. Carrier 25 also includes top access opening 18 and bottom access opening 19 at pocket one S1. These are included to provide a means to grab lighting device L1 when the responder wishes to remove lighting device L1 from its pocket. Top access opening 18 and bottom access opening 19 permit gripping of lighting device L1 with two fingers to facilitate its removal from pocket one S1. Lighting device L1 can be removed and installed in carrier 25 with a responder's one hand holding carrier 25 at handle 12 and the responders other hand pulling it from slot one S1. It is not required to open a cover or rotate handle 12 relative to carrier 25 to removeably install or activate lighting device L1. The present design, therefore avoids fumbling or delays as the responder deploys the lighting devices. Pocket one S1, opening one 01 and top access opening 18 additionally provide an unobstructed view of window 5 when viewed from a horizontal distance from left side 25L of carrier 25. This permits an unattenuated portion HBU of horizontal light beam HB emerging from lighting device L1 to pass exterior to carrier 25 without being attenuated or diffused.

Lanyard 8 as shown in FIG. 1 can be added to lighting device L1 to facilitate its removal from pocket one S1 of carrier 25. Also by positioning main switch 6 of lighting device L1 at top access opening 18 of pocket one S1 lighting device L1 can be easily energized by activating main switch 6 while still in carrier 25. Carrier 25 includes similar pockets, openings and restrictions for each of the lighting devices being stored or carried.

Looking again at FIGS. 1 and 6 it can be seen that openings for the installation of lighting device L1, activation of main switch 6 of lighting device L1 and unattenuated passage of light from lighting device L1 can overlap and intersect such that one opening can provide one or any combination of the aforementioned functions for one or all of the held lighting devices. Therefore one opening can function for one or any combination of functions including installing at least one of said plurality of lighting devices in said carrier, activating a switch of at least one of said plurality of lighting devices, passing light from at least one of said lighting devices unattenuated exterior to said carrier and permitting gripping of any of said lighting devices to facilitate its removal from said carrier.

Figure 9:
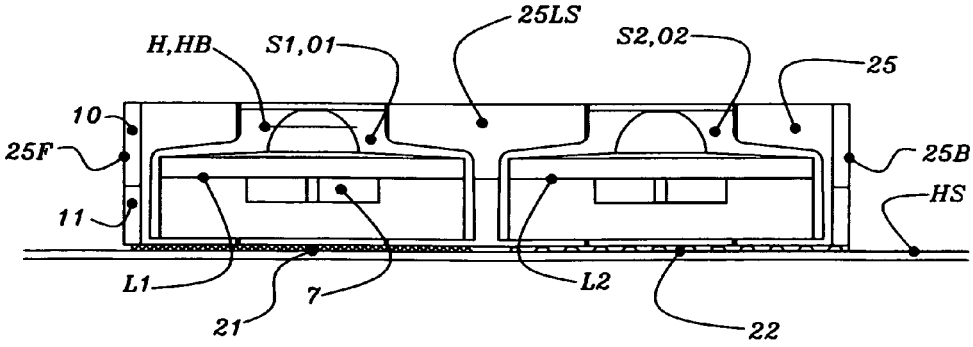
FIG. 9 shows visible light transporter 1 of FIG. 1 on a horizontal shelf in a storage orientation

FIG. 9 shows visible light transporter 1 holding four lights and standing on metallic horizontal shelf HS. In FIG. 9 velcro strip set 21 and magnetic strip 22 are glued to carrier bottom 11 for attachment to metal horizontal shelf HS permitting carrier 25 to be securely but temporarily attached to horizontal shelf HS. Although FIG. 9 shows both velcro strip set 21 and magnetic strip 22 attaching carrier 25 to horizontal shelf HS either can be employed separately. Lighting devices L1 through L4 can as previously described easily be removed or added to carrier 25 even while it is attached to horizontal shelf HS. Carrier 25 is at a standing orientation on horizontal shelf HS and the lights are held such that their horizontal light beams HB are directed parallel to horizontal plane H.

FIG. 10 is an assembly view of carrier 25 from FIG. 1. It shows carrier 25 assembled from molded components and having carrier top 10 attached to carrier bottom 11 forming body 9 with six self threading screws 20. Handle 12 wings 13 upon being spread snap into tracks 14 on carrier bottom 11.

FIG. 11 is a perspective view of carrier bottom 11 removed from FIG. 10 showing a portion of pockets S1 through S4 the contour of each made to accommodate the shape of lighting devices L1 through L4.

It is noteworthy to realize that in FIG. 10 carrier top 10 could be deleted from body 9 and still permit body 9 to function as one embodiment of the present invention. Handle 12 would still attach to carrier bottom 11. Carrier bottom 11 would need a change in the contour of each pocket so that the lighting devices would not move horizontally and fall out of the carrier. In that regard projection 26 which is not a part of carrier bottom 11 shown in FIG. 1 is added in FIG. 11 as one possible change in contour which could be added to pocket one S1 to keep lighting device L1 in place in the carrier. In this configuration of body 9 lighting devices L1 through L4 would be moved vertically to remove them from the carrier. It would also have only one opening for passage of light from the lighting devices exterior to the carrier, installation of the lighting devices, switch activation of the lighting devices and gripping of the lighting devices. This configuration of the carrier would also incorporate concepts of the present invention.

Obviously, many modifications may be made without departing from the basic spirit of the present invention.

Accordingly, it will be appreciated by those skilled in the art that within the scope of the appended claims, the invention may be practiced other than has been specifically described herein.

FIGS. 12 through 14 describe prior art road flare kit 27. Looking at FIGS. 12 and 13 road flare kit 27 comprises case 28 having case cover 29 rotatably attached to case bottom 30 with hinge 31. Latches 32A and 32B are used to hold case cover 29 to case bottom 30 to maintain a closed orientation of case 28. Handle 33 is rotatably attached to case cover 29 permitting it to fold down for storage. FIG. 13 is a partial cross section of road flare kit 27 of FIG. 1 and it shows identical lights 34A, 34B, 34C, 34D and 34E stacked within case 28. Light 34A is typical and emits a rotating horizontal light beam prior art HBP generated by a group of approximately twenty led lamps disposed in a circular pattern and energized in sequence to create a rotating effect.

FIG. 14 shows kit 27 in a transporting orientation where case 28 (also called body or carrier) is held by handle 33 and secured by latches 32A and 32B with earth reference vertical V perpendicular to horizontal light beam prior art HBP.

FIG. 15 shows kit 27 held by handle 33 but no longer in a transporting configuration with latches 32A and 32B unlatched resulting in a rotation of case bottom 30 such that some of the held lights could fall out. Horizontal light beam prior art HBP is angled so that it is no longer along horizontal plane H.

Case 28 is constructed of an orange plastic which is substantially opaque. The manufacturer of kit 27 states that the light is visible for 25 miles from the air and is so bright that it can be seen through the case. This is impressive regarding the intensity of his light because his case is substantially opaque. If the design was meant to create a visible light carrier then his case would have been translucent or transparent and the fact that his light was visible through the case would not have been noteworthy. In addition, although he does state that the light is visible through the case he does not indicate that the emerging light is bright enough to function as a safety device warning signal. He does not offer the concept of energizing the plurality of lights within his case. Nor does he offer the concept of energizing the plurality of lights within the case during transportation or deployment of the lights.

In addition, if a responder did walk down a road with case 28 in a transporting orientation held by handle 33 and with all held lights energized his visibility would, unlike the present invention, be minimal due to the low transmissivity of opaque case 28. In this transporting orientation case 28 is in its transporting configuration held closed with latches 32A and 32B. If the responder needed to remove one of the held lights he would have to open case 28 thereby changing its configuration. Furthermore, unlatching and opening case 28 in traffic would be problematic as shown in FIG. 15 wherein case bottom 30 would drop and rotate possibly releasing lights onto the pavement and certainly misdirecting emitted light beams. Also in order to use this prior art design as a visible light transporter upon arriving at an accident the responder would have to open case 28 remove and activate all of the lights, replace them in case 28 and latch it closed. This is an unacceptably long process.

Finally in this prior art design each of the lights have a large quantity (approximately 20) of led lamps sequently energized to create a rotating effect. The result of placing a group of lights each with a large quantity of led lamps flashing in a translucent carrier is that the large quantity of flashes tend to combine to approach a steady light such that the carrier appears to be evenly illuminated. The prior art does not offer a translucent carrier but if it did due to the rotating light of the held lights the carrier would not have the spectacular visibility of the present invention. The present invention employs lighting devices each having a single powerful led lamp which pulses. Thus although the pulses combine to create a visual carrier having a sum of the frequencies of the held lights the total number of pulses is not enough to combine to approach a steady light.

I claim:

1. A visible light transporter comprising:

a plurality of portable lighting devices; and a carrier for holding said plurality of portable lighting devices and having some of a light emitted by each of said plurality of lighting devices pass unattenuated exterior to said carrier whereby the light from said plurality of lighting devices combines exterior to said carrier to make said carrier appear as a large visible light source.

2. A visible light transporter according to claim 1 which further comprises:

said carrier having at least one opening for the light from said plurality of lighting devices to pass unattenuated exterior to said carrier and about a horizontal.

3. A visible light transporter according to claim 1 which further comprises:

said carrier at a transporting orientation having at least one opening for installing said plurality of lighting devices in said carrier.

4. A visible light transporter according to claim 1 which further comprises:

said carrier at least partially constructed of a light transmitting material; and each of said plurality of lighting devices having some of said light intersecting said carrier and transmitted through said carrier.

5. A visible light transporter according to claim 1 which further comprises:

said light from each of said plurality of lighting devices pulsing whereby said carrier appears to be pulsing at a frequency higher than the frequency of any one of said plurality of lighting devices.

6. A visible light transporter carrier according to claim 1 which further comprises:

said carrier having a handle and upon being held by said handle disposed substantially at a transporting orientation; and each of said plurality of lighting devices at a deployment orientation having said light concentrated into a light beam substantially about a horizontal and upon said carrier at said transporting orientation said plurality of lighting devices disposed substantially at said deployment orientation.

7. A visible light transporter according to claim 1 which further comprises:

said carrier having a transporting configuration and a handle attached to said carrier; and upon said carrier being disposed at said transporting configuration said handle having a nonrotatable relationship relative to a body of said carrier.

8. A visible light transporter according to claim 1 which further comprises:

said light from each of said plurality of lighting devices pulsing; and said plurality of lighting devices having a plurality of light emission points separated by a distance of at least two inches whereby a light jumping effect is created to improve visibility of said carrier.

9. A visible light transporter comprising:

a plurality of portable lighting devices;

a carrier at least partially constructed of a light transmitting material; and said carrier for holding said plurality of portable lighting devices and having some of a light emitted by each of said plurality of lighting devices intersecting said carrier and transmitted through said carrier whereby the light from said plurality of lighting devices transmitted through said carrier combines to make said carrier appear as a large visible light source.

10. A visible light transporter according to claim 9 which further comprises:

said light transmitting material having a transmissivity exceeding seventy five percent when tested with a light of the color expected to be transmitted.

11. A visible light transporter according to claim 9 which further comprises:

said light from each of said plurality of lighting devices pulsing whereby said carrier appears to be pulsing at a frequency higher than the frequency of any one of said plurality of lighting devices.

12. A visible light transporter according to claim 9 which further comprises:

said carrier having at least one opening for some of the light from said plurality of portable lighting devices to pass unattenuated exterior to said carrier.

13. A visible light transporter according to claim 9 which further comprises:

said carrier at a transporting configuration having at least one opening for installing said plurality of lighting devices in said carrier.

14. A visible light transporter according to claim 9 which further comprises:

said carrier having a handle and upon being held by said handle disposed substantially at a transporting orientation; and each of said plurality of lighting devices at a deployment orientation having said light concentrated into a light beam substantially about a horizontal and upon said carrier at said transporting orientation said plurality of lighting devices disposed substantially at said deployment orientation.

15. A visible light transporter according to claim 9 which further comprises:

said carrier having a transporting configuration and a handle attached to said carrier; and upon said carrier being disposed at said transporting configuration said handle having a nonrotatable relationship relative to a body of said carrier.

16. A visible light transporter according to claim 9 which further comprises:

said light from each of said plurality of lighting devices pulsing; and said plurality of lighting devices having a plurality of light emission points separated by a distance of at least two inches whereby a light jumping effect is created to improve the visibility of said carrier.

17. A visible light transporter according to claim 9 which further comprises:

said light transmitting material a translucent resin having a diffuse transmissivity exceeding twenty five percent when tested with a light of the color expected to be transmitted.

18. A visible light transporter comprising:

a plurality of portable lighting devices;

each of said plurality of portable lighting devices having a pocket in said a carrier for holding said lighting device; and said carrier having some of a light emitted by each of said plurality of lighting devices pass unattenuated exterior to said carrier whereby the light from said plurality of lighting devices combines exterior to said carrier to make said carrier appear as a large visible light source.

19. A visible light transporter according to claim 18 which further includes:

said carrier having at least one opening for the light from said plurality of lighting devices to pass unattenuated exterior to said carrier and about a horizontal.

20. A visible light transporter according to claim 18 which further includes:

said carrier at a transporting configuration having at least one opening for installing said plurality of lighting devices in said carrier.

21. A visible light transporter according to claim 18 which further includes:

said carrier at least partially constructed of a light transmitting material; and each of said plurality of lighting devices having some of said light intersecting said carrier and transmitted through said carrier.

22. A visible light transporter according to claim 18 which further includes:

said light from each of said plurality of lighting devices pulsing wherein said carrier appears to be pulsing at a frequency higher than the frequency of any one of said plurality of lighting devices.

23. A visible light transporter according to claim 18 which further includes:

said carrier having a handle and upon being held by said handle disposed substantially at a transporting orientation; and each of said plurality of lighting devices at a deployment orientation having said light concentrated into a light beam substantially about a horizontal and upon said carrier at said transporting orientation said plurality of lighting devices disposed substantially at said deployment orientation.

24. A visible light transporter according to claim 18 which further includes:

said carrier having a transporting configuration and a handle attached to said carrier; and upon said carrier being disposed at said transporting configuration said handle having a nonrotatable relationship relative to a body of said carrier.

25. A visible light transporter according to claim 18 which further includes:

said light from each of said plurality of lighting devices pulsing; and said plurality of lighting devices having a plurality of light emission points separated by a distance of at least two inches whereby a light jumping effect is created to improve the visibility of said carrier.

26. A visible light transporter comprising:

a plurality of portable lighting devices;

a carrier at least partially constructed of a light transmitting material and having a plurality of pockets for holding each of said plurality of lighting devices in a pocket; and said carrier having some of a light emitted by each of said plurality of lighting devices intersecting and transmitted through said carrier whereby the light transmitted through said carrier from said plurality of lighting devices combines to make said carrier appear as a large light source.

27. A visible light transporter according to claim 26 which further comprises:

said carrier at least partially diffusing the light transmitted through said carrier.

28. A visible light transporter according to claim 26 which further comprises:

said light from each of said plurality of lighting devices pulsing whereby said carrier appears to be pulsing at a frequency higher than the frequency of any one of said plurality of lighting devices.

29. A visible light transporter according to claim 26 which further comprises:

said carrier having at least one opening for some of the light from said plurality of portable lighting devices to pass unattenuated exterior to said carrier.

30. A visible light transporter according to claim 26 which further comprises:

said carrier at a transporting configuration having at least one opening for installing said plurality of lighting devices in said carrier.

31. A visible light transporter according to claim 26 which further comprises:

said carrier having a handle and upon being held by said handle disposed substantially at a transporting orientation; and each of said plurality of lighting devices at a deployment orientation having said light concentrated into a light beam substantially about a horizontal and upon said carrier at said transporting orientation said plurality of lighting devices disposed substantially at said deployment orientation.

32. A visible light transporter according to claim 26 which further comprises:

said carrier having a transporting configuration and a handle attached to said carrier; and upon said carrier being disposed at said transporting configuration said handle having a nonrotatable relationship relative to a body of said carrier.

33. A visible light transporter according to claim 26 which further comprises:

said light from each of said plurality of lighting devices pulsing; and said plurality of lighting devices having a plurality of light emission points separated by a distance of at least two inches whereby a light jumping effect is created to improve the visibility of said carrier.

34. A visible light transporter comprising:

a carrier for holding each of a plurality of portable lighting devices, each said lighting device emitting a pulsing light and each held in a pocket, each said pocket comprising an opening on a side of said carrier, said carrier having some of said pulsing light emitted by each of said plurality of lighting devices pass unattenuated through an opening in said carrier exterior to said carrier whereby the light from said plurality of lighting devices combines to make said carrier appear as a large pulsing light source.

35. A visible light transporter according to claim 34 which further comprises:

said plurality of lighting devices having a plurality of light emission points separated by a distance of at least two inches whereby a light jumping effect is created to improve the visibility of said carrier.

36. A visible light transporter comprising:

a carrier at least partially constructed of a light transmitting material; and said carrier for holding each of a plurality of portable lighting devices, each said lighting device emitting a pulsing light and each held in a pocket, each said pocket comprising an opening on a side of said carrier, said carrier having some of said pulsing light emitted by each of said plurality of lighting devices transmitted through said carrier whereby the light from said plurality of lighting devices transmitted through said carrier combines to make said carrier appear as a large pulsing light source.

37. A visible light transporter according to claim 36 which further comprises:

said plurality of lighting devices having a plurality of light emission points separated by a distance of at least two inches whereby a light jumping effect is created to improve the visibility of said carrier.

38. A method for making a road flare light transporter appear as a highly visible safety device, comprising the steps of:

(a) providing a plurality of portable lighting devices each emitting a pulsing light, (b) providing a carrier for holding said plurality of lighting devices, said carrier at least partially constructed of a light transmitting material, and (c) installing said plurality of lighting devices in said carrier whereby some of said pulsing light from said plurality of lighting devices passes through said carrier to make said light transporter appear as a highly visible safety device.

39. A method for making a road flare light transporter appear as a highly visible safety device, comprising the steps of:

(a) providing a plurality of portable lighting devices each emitting a pulsing light, (b) providing a carrier comprising a transporting orientation having a transporting configuration comprising at least one opening for some of said pulsing light from said plurality of lighting devices to pass unattenuated exterior to said housing, and (c) installing said plurality of lighting devices in said carrier whereby some of said pulsing light from said plurality of lighting devices passes through said carrier to make said light transporter appear as a highly visible safety device.

* * * * *